US010498064B2

(12) United States Patent
Hirano

(10) Patent No.: US 10,498,064 B2
(45) Date of Patent: Dec. 3, 2019

(54) TERMINAL

(71) Applicant: Sumitomo Wiring Systems, Ltd., Yokkaichi, Mie (JP)

(72) Inventor: Shinji Hirano, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/125,823

(22) Filed: Sep. 10, 2018

(65) Prior Publication Data

US 2019/0089084 A1 Mar. 21, 2019

(30) Foreign Application Priority Data

Sep. 21, 2017 (JP) ..... 2017-180967

(51) Int. Cl.
*H01R 13/24* (2006.01)
*H01R 13/41* (2006.01)

(52) U.S. Cl.
CPC ..... *H01R 13/2442* (2013.01); *H01R 13/41* (2013.01)

(58) Field of Classification Search
CPC ..... H01R 13/113; H01R 4/16; H01R 4/02; H01R 13/115; H01R 13/24; H01R 13/41
See application file for complete search history.

(56) References Cited

U.S. PATENT DOCUMENTS 6,019,646 A * 2/2000 Okamura ..... H01R 13/113 439/748
6,428,365 B1 * 8/2002 Yamamoto ..... H01R 13/113 439/843
7,419,411 B2 * 9/2008 Kaneko ..... H01R 13/113 439/851
9,455,516 B2 * 9/2016 Gutenschwager ... H01R 13/187
2004/0116002 A1 * 6/2004 Rozet ..... H01R 13/187 439/843

FOREIGN PATENT DOCUMENTS

JP 2014-238940 12/2014

* cited by examiner

*Primary Examiner* — Xuong M Chung Trans
(74) *Attorney, Agent, or Firm* — Gerald E. Hespos; Michael J. Porco; Matthew T. Hespos

(57) ABSTRACT

A terminal includes a bottom wall (12), two side walls (13) rising from the bottom wall (12) and a ceiling wall (14) continuous from the side walls (13) and facing the bottom wall (12), thereby defining a rectangular tube (10) open in a front-rear direction. A resilient contact piece (22) is arranged inside the rectangular tube (10) and has a contact point (22A) facing the ceiling wall (14). Inclination restricting portions (24, 124) are arranged to be perpendicular to the ceiling wall (14) at a lateral side of the contact point (22A) and are provided with facing edge parts (24A, 124A) facing the ceiling wall (14).

7 Claims, 12 Drawing Sheets

TERMINAL

BACKGROUND

Field of the Invention

This specification relates to a terminal.

Related Art

Japanese Unexamined Patent Publication No. 2014-238940 discloses a female terminal with a terminal body and a spring. The terminal body includes a rectangular tubular portion. The spring is formed separate from the terminal body and includes an inner frame arranged in the tubular portion. Spring contacts are formed by cutting and bending upper and lower surfaces of the inner frame and are arranged inside the inner frame. Excessive inclination restricting walls are formed by cutting and bending left and right side walls of the inner frame.

When a male terminal is inserted into the inner frame portion, contact point spring portions of the spring contacts are deformed resiliently to allow the insertion of the male terminal. If the inserted male terminal is inclined obliquely, the male terminal contacts the excessive inclination restricting walls on front and back surfaces of left and right end parts to restrict any further inclination. In this way, the male terminal and the contact point spring portions are held in a contact state.

However, the excessive inclination restricting wall portions are formed by cutting and bending the left and right side walls of the inner frame. Thus, bending margins have to be provided in the inner frame, leading to the enlargement of the inner frame and the entire tubular portion. Further, the excessive inclination restricting walls are formed by cutting and bending parts of the inner frame and easily deform by yielding to a pressure from the male terminal.

SUMMARY

The invention relates to a terminal composed of a bottom wall, two side walls rising from the bottom wall and a ceiling wall continuous from the side walls and facing the bottom wall to define a rectangular tube open in a front-rear direction. A resilient contact piece is arranged inside the rectangular tube and has a contact point facing the ceiling wall. An inclination restricting portion is perpendicular to the ceiling wall at a lateral side of the contact point and has a facing edge facing the ceiling wall.

According to this configuration, the inclination restricting portion provided laterally to the contact point contacts a mating terminal when the mating terminal (tab) is inclined laterally in the rectangular tube. Thus, excessive inclination of the tab can be restricted. Further, the inclination restricting portion is perpendicular to the ceiling wall and the facing edge facing the ceiling wall contacts the tab. Thus, excessive inclination of the tab can be restricted with higher rigidity, for example, as compared to the case where the inclination restricting portion is an inclined wall disposed in a cantilevered state with plate surfaces held in parallel to the ceiling wall.

The inclination restricting portion may extend in a direction intersecting the front-rear direction. According to this configuration, any one part of the inclination restricting portion in the direction intersecting the front-rear direction can contact the tab. Thus, excessive inclination of the tab can be restricted even if the tab is displaced laterally.

The terminal may further includes a straight portion extending along the side wall from one end of the inclination restricting portion, and the inclination restricting portion and the contact point may overlap in a side view. According to this configuration, the inclination restricting portion is coupled to the straight portion. Thus, the inclination restricting portion is less likely to fall down even upon receiving a strong force from the tab. Further, in the case of forming the inclination restricting portion and the straight portion by bending one metal plate, the inclination restricting portion can be arranged by adjusting a bending angle even if a clearance lateral to the contact point is narrow. Further, since excessive inclination of the tab is restricted at the lateral side of the contact point, the contact point and the tab can be held connected.

The inclination restricting portion may include a straight portion extending straight along the side wall and an embossment projecting toward the side wall. According to this configuration, the embossment is sandwiched between the lateral straight portion and the side wall at a lateral side of the resilient contact piece. Thus, a lateral displacement of the inclination restricting portion in the rectangular tube can be suppressed. In this way, rattling of the inclination restricting portion can be suppressed and a relative positional deviation from the tab can be reduced. Further, a projecting height of the embossment can be adjusted freely, for example, if the embossment is formed by embossing, the inclination restricting portion can be provided even if the clearance between the resilient contact piece and the side wall is small.

The terminal further may include a front restricting portion that is perpendicular to the ceiling wall and disposed side by side with the inclination restricting portion in the front-rear direction. According to this configuration, excessive inclination of the tab is restricted at two positions, i.e. at the inclination restricting portion and the front restricting portion disposed side by side with the inclination restricting portion in the front-rear direction. Thus, a stable connected state of the tab and the contact point is maintained.

Accordingly, the terminal disclosed in this specification can restrict excessive inclination of the mating terminal without enlarging the terminal.

DETAILED DESCRIPTION

A first embodiment of the invention is described with reference to FIGS. 1 to 8. Note that, in the following description, a left-upper side and an upper side in FIG. 1 are referred to as a front side and an upper side.

Figure 1:
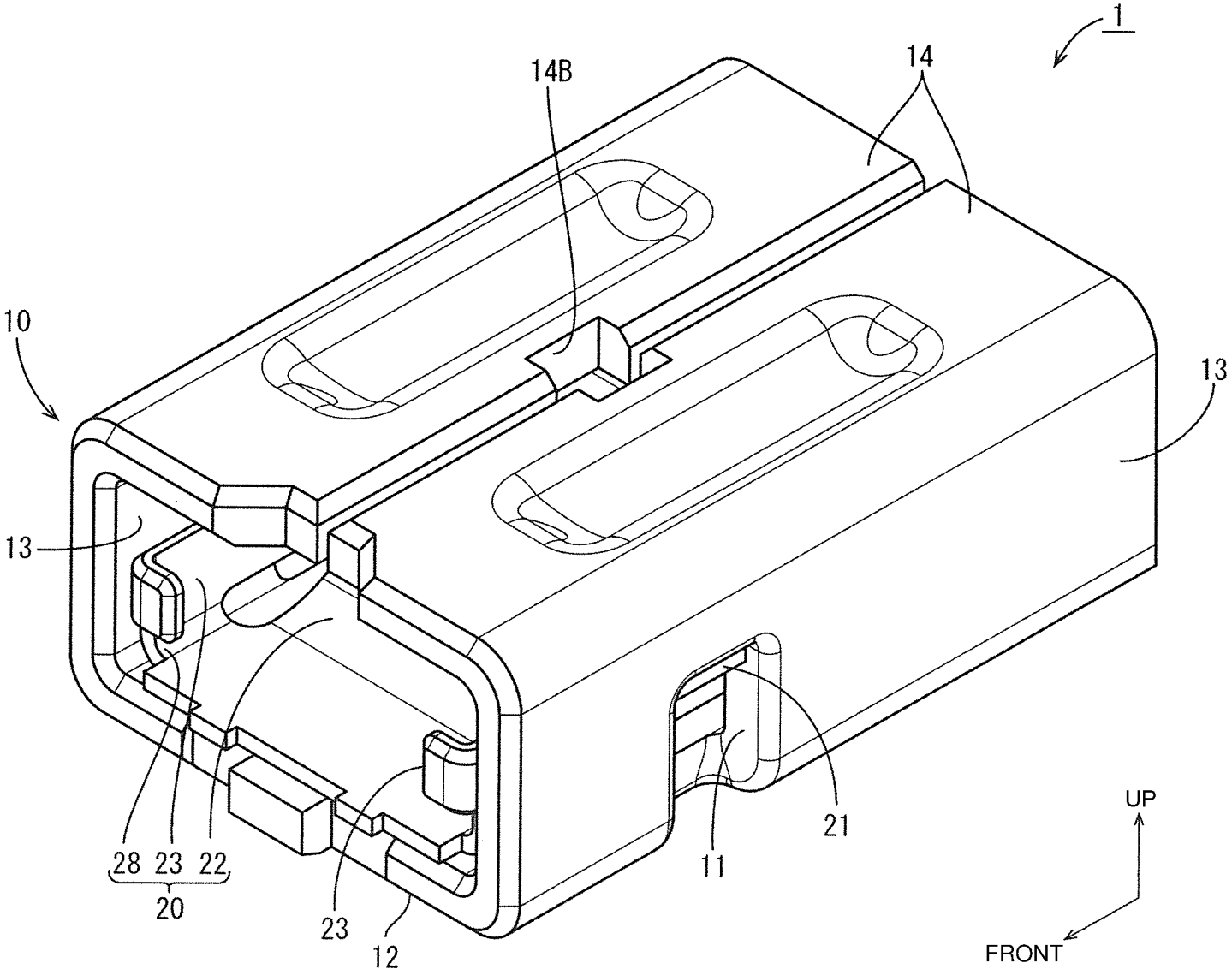
FIG. 1 is a perspective view showing a terminal according to a first embodiment.

A terminal 1 of this embodiment is a female terminal to be connected to a mating terminal and includes, as shown in FIG. 1, a rectangular tube 10 and a spring 20 arranged in the rectangular tube 10. The spring 20 is provided with locking pieces 21, that are locked to cuts 11 provided in the rectangular tube 10 to fix the spring 20 in the rectangular tube 10.

Figure 5:
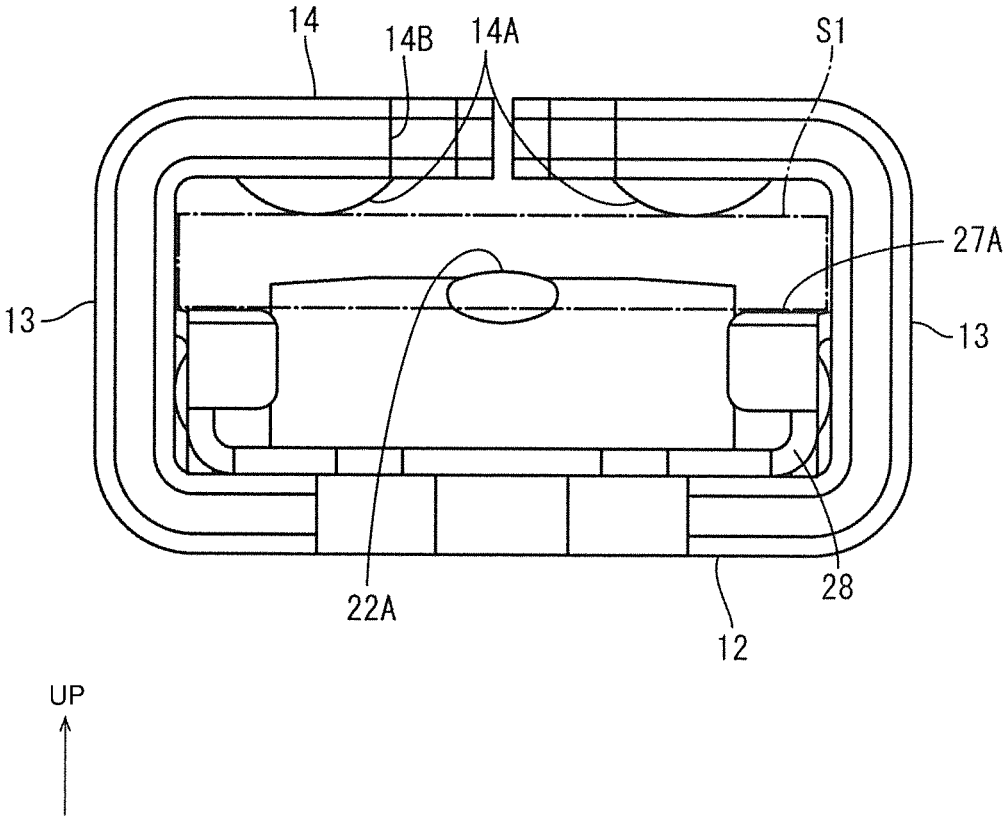
FIG. 5 is a front view showing the terminal.

The rectangular tube 10 is formed by applying stamping and bending to a metal plate. As shown in FIGS. 1 and 5, the rectangular tube 10 is open at both ends and includes a bottom wall 12, two side walls 13 and a ceiling wall 14.

Figure 4:
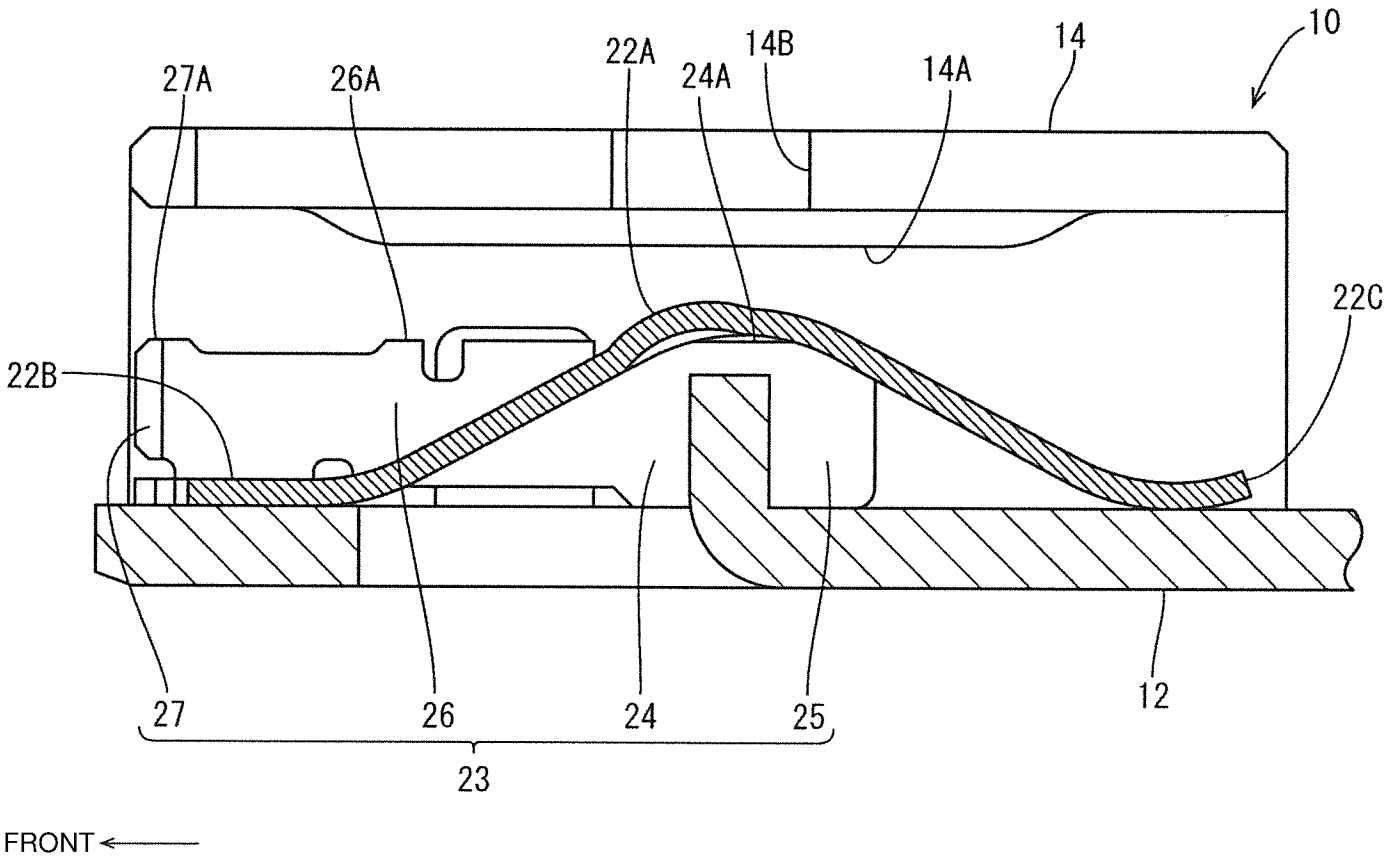
FIG. 4 is a section along A-A of FIG. 2.

The side walls 13 rise perpendicularly from both side edges of the bottom wall 12 and are disposed to face each other. The ceiling wall 14 is composed of two ceiling plates connected to upper ends of the side walls 13 and extending toward each other and disposed to face the bottom wall 12. As shown in FIGS. 4 and 5, the ceiling wall 14 has two bilaterally symmetrical contact ridges 14A projecting down and extending in a front-rear direction. An opening 14B is provided in a substantially central part of the ceiling wall 14 and allows an internal space of the rectangular tube 10 to communicate with outside. The opening 14B can be utilized, for example, to confirm a connected state of a contact point 22A of a resilient contact piece 22 to be described later and a tab T of the mating terminal. Note that the tab T of this embodiment has a flat rectangular cross-sectional shape.

The spring 20 is formed by applying stamping, bending and the like to one relatively thin metal plate material. As shown in FIG. 1, the spring 20 integrally includes the resilient contact piece 22 to be brought into contact with the tab T and two inner walls 23 disposed around the resilient contact piece 22. The resilient contact piece 22 and the inner walls 23 are coupled by bending edges 28.

Figure 6:
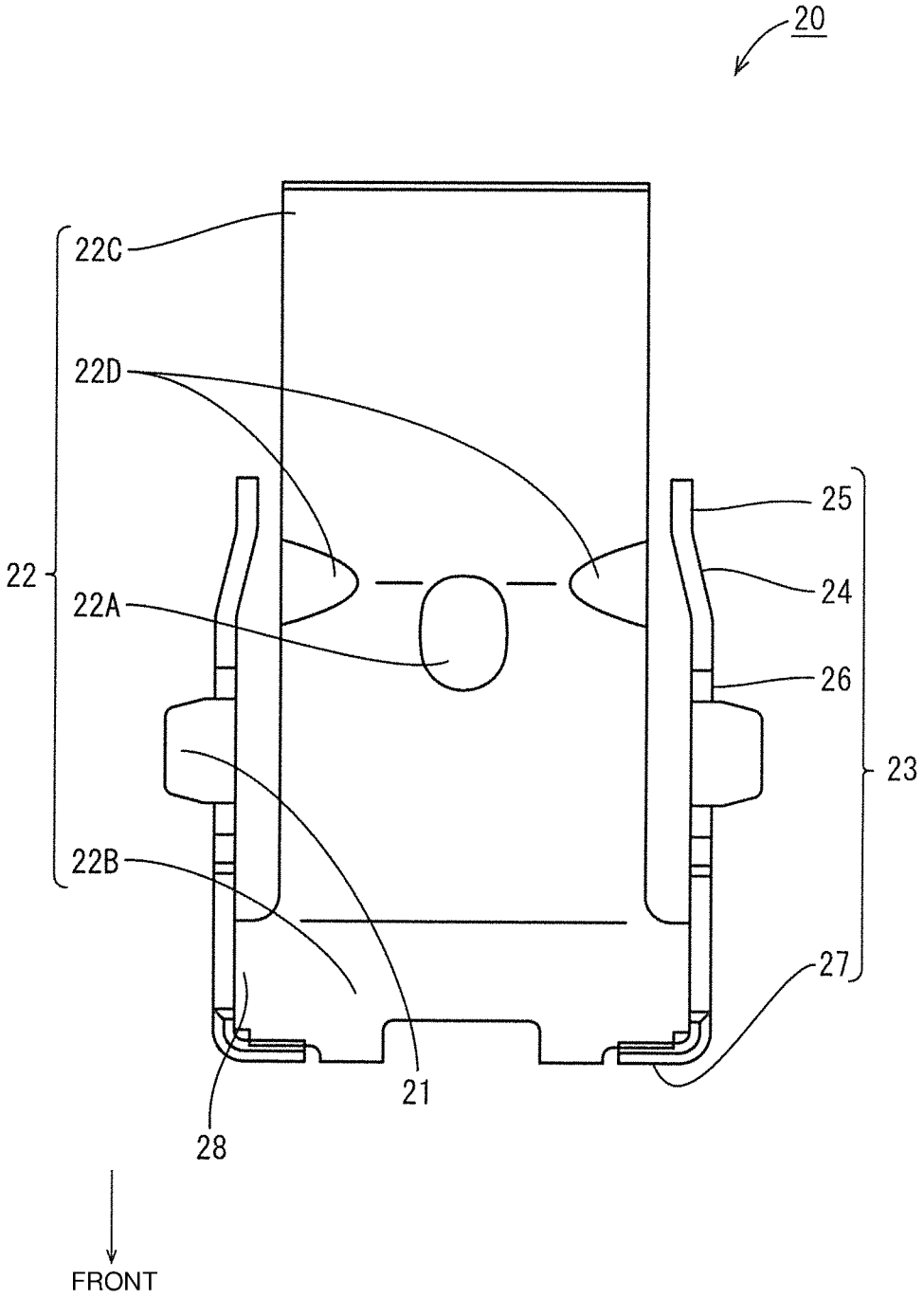
FIG. 6 is a plan view showing a spring member.
Figure 7:
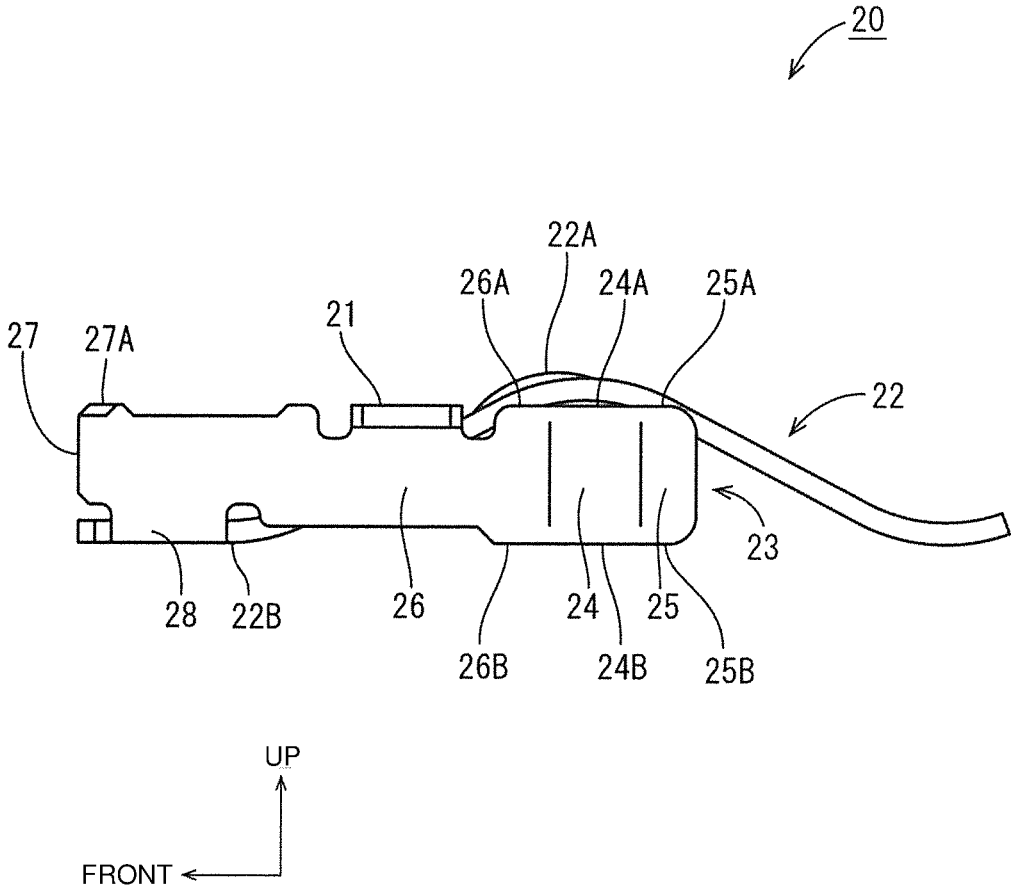
FIG. 7 is a side view showing the spring member.
Figure 8A:
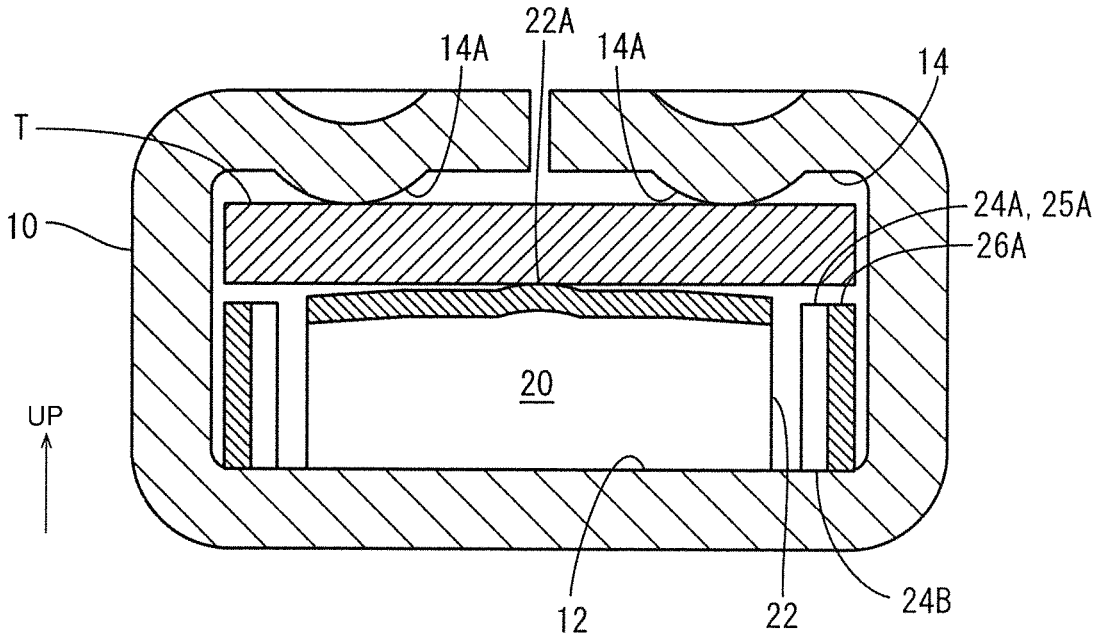
FIGS. 8(A) and 8(B) are sections showing a state at a proper position and a state with a maximum positional deviation.
Figure 8B:
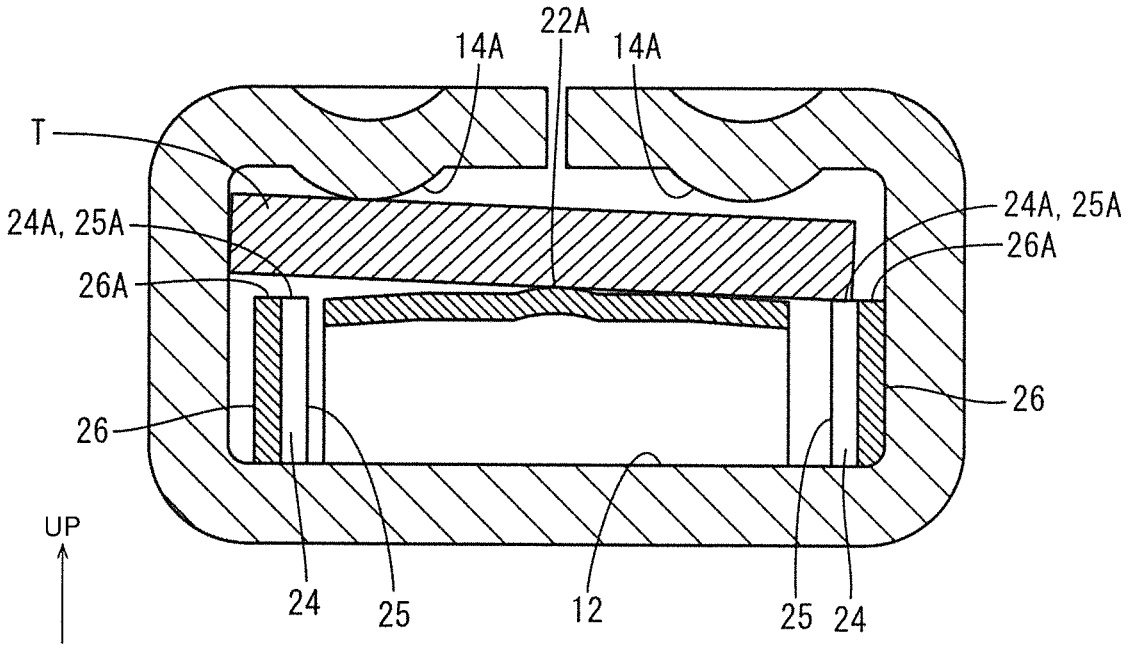

As shown in FIG. 7, the resilient contact piece 22 is a cantilevered spring piece in the form of a long and narrow strip and has a chevron shape with a central part in the front-rear direction raised up with a front side serving as a base 22B and a rear side serving as a free end part 22C. As shown in FIG. 6, the convex contact point 22A is in a lateral center near a top of this raised part and projects toward the ceiling wall 14. As shown in FIGS. 8(A) and 8(B), the contact point 22A contacts the tab T inserted into the rectangular tube 10. Tapered portions 22D are provided laterally to the contact point 22A and gently incline down toward both ends of the resilient contact piece 22.

As shown in FIGS. 6 and 7, the inner wall 23 includes an inclination restricting portion 24 disposed at each side of the contact point 22A, a rear straight portion 25, a front rear straight portion 26 and a front restricting portion 27.

The inclination restricting portion 24 overlaps the contact point 22A of the resilient contact piece 22 in a side view and extends straight from the front end to the rear end thereof while approaching a side edge of the resilient contact piece 22.

The rear straight portion 25 is coupled to a rear end of the inclination restricting portion 24 and extends straight in parallel to the side edge of the resilient contact piece 22.

The front straight portion 26 is coupled to a front end of the inclination restricting portion 24 and extends straight in parallel to the side edge of the resilient contact piece 22. Note that the aforementioned locking piece 21 is provided on the front straight portion 26 and projects laterally out.

The front restricting portion 27 is coupled to a front end of the front straight portion 26 and extends straight toward the other front restricting portion 27 along a front edge of the resilient contact piece 22 (base end part 22B).

The bending edges 28 protrude laterally from both side edges of the base end 22B of the resilient contact piece 22, are bent up at a right angle and are coupled to lower ends of the front straight portions 26 of the inner walls 23. That is, the inclination restricting portions 24 extend in directions intersecting the front-rear direction within protruding widths of the bending edges 28 from the side edges of the base end 22B.

Figure 2:
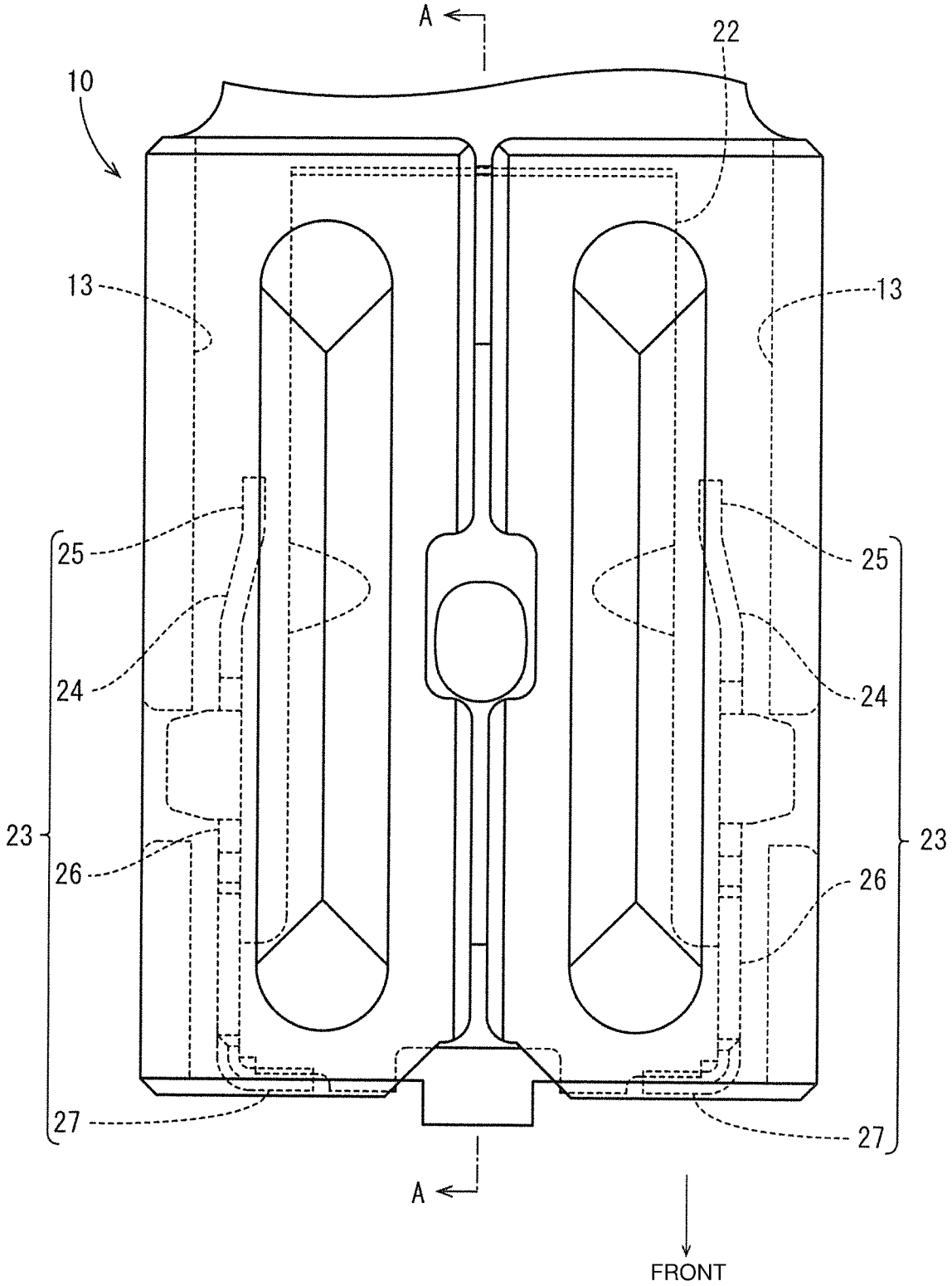
FIG. 2 is a plan view showing the terminal.
Figure 3:
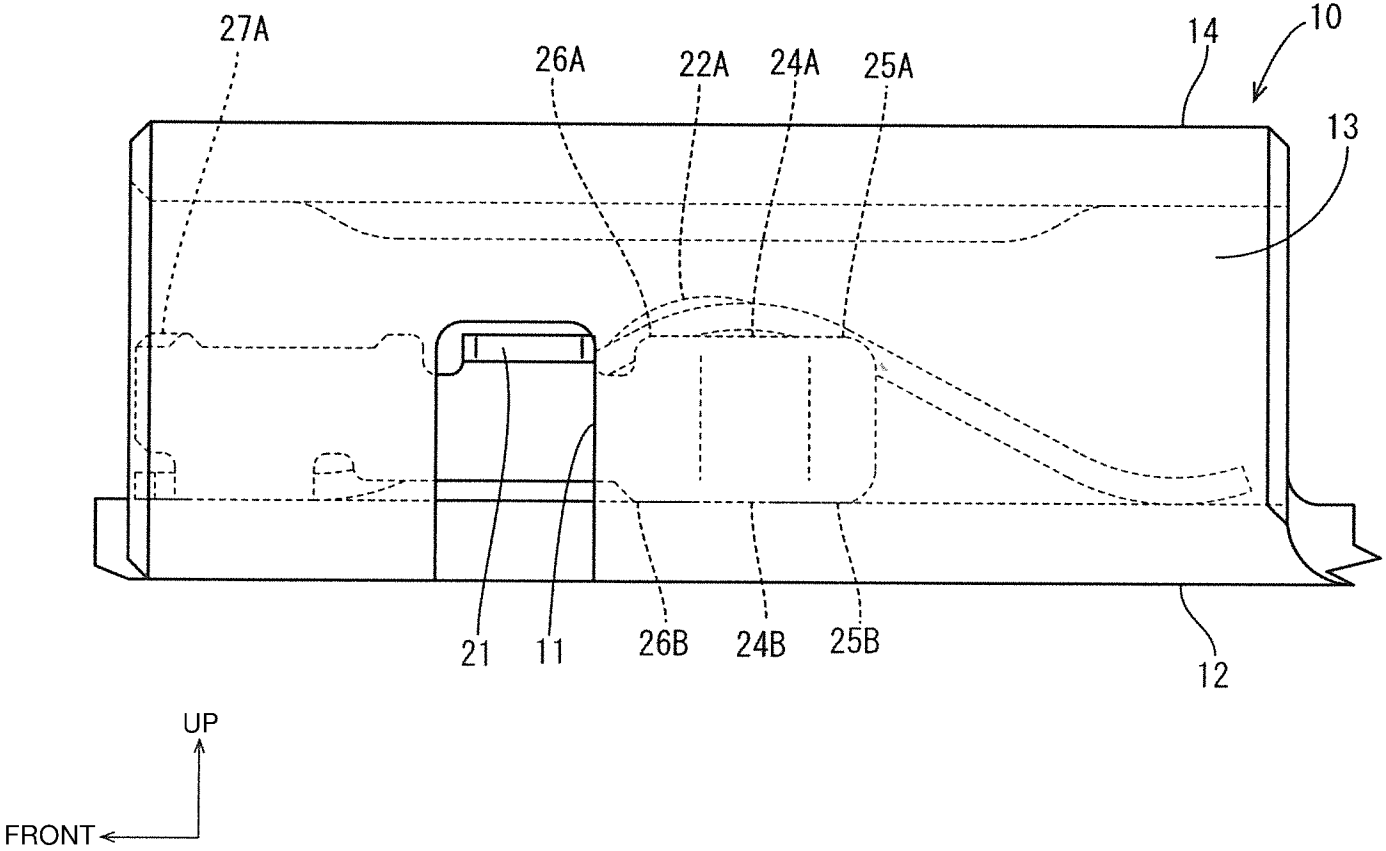
FIG. 3 is a side view showing the terminal.

With the spring 20 arranged in the rectangular tube 10, the resilient contact piece 22 is parallel to the side walls 13, as shown in FIG. 2, with the base end 22B held in surface contact near the front end of the bottom wall 12 and the free end 22C held in contact near the rear end of the bottom wall 12, as shown in FIG. 4. As shown in FIGS. 2 and 3, the inner walls 23 are arranged to be perpendicular to the ceiling wall 14. An entrance allowing space S1 for allowing the entrance of the tab T into the rectangular tube 10 is formed between lower ends of the contact ridges 14A of the ceiling wall 14 and the inner walls 23, as shown in FIG. 5.

As shown in FIG. 2, the inclination restricting portion 24, the rear straight portion 25 and the front straight portion 26 are disposed in a clearance between the resilient contact piece 22 and the corresponding side wall 13. A rear end of the inclination restricting portion 24 and the rear straight portion 25 are disposed near the resilient contact piece 22, the inclination restricting portion 24 extends in a direction intersecting the front-rear direction and a front end of the inclination restricting portion 24 and the front straight portion 26 are disposed near the corresponding side wall 13. A lower end 24B of the inclination restricting portion 24, a lower end 25B of the rear straight portion 25 and a lower end 26B of the front straight portion 26 are disposed in contact with the bottom wall 12 or disposed to be able to contact the bottom wall 12. An upper end 24A of the inclination restricting portion 24 serves as a facing edge 24A facing the ceiling wall 14. Further, an upper edge 25A of the rear straight portion 25 and an upper edge 26A of the front straight portion 26 also face the ceiling wall 14.

The front restricting portion 27 is arranged so that the front surface is substantially aligned with a front opening of the rectangular tube 10. Specifically, the front restricting portion 27 is interposed between the resilient contact piece 22 and a front space of the rectangular tube 10, thereby restricting an entrance allowing area for the tab T in a front opening of the rectangular tube 10 and preventing the tab T from coming into contact with a front end of the resilient contact piece 22. An upper end edge 27A of the front restricting portion 27 is facing the ceiling wall 14.

If the spring 20 is disposed at a position where a center line thereof in the lateral direction is aligned with that of the rectangular tube 10 and the tab T is at a position where a center line in the lateral direction is aligned with that of the spring 20, as shown in FIG. 8(A) (hereinafter, referred to as a state at a proper position), the tab T comes into contact with the contact point portion 22A of the resilient contact piece 22, is pressed against each contact ridge 14A by a resilient restoring force of the resilient contact piece 22 and is held parallel to the ceiling wall 14. In this state, both side end parts of the tab T are located above the facing edges 24A of the inclination restricting portions 24, the upper end edges 25A of the rear straight portions 25 and the upper end edges 26A of the front straight portions 26.

In this state, if the tab T is pushed down in a laterally balanced manner, the facing edges 24A and the respective upper end edges 25A and 26A on both sides contact the tab T to restrict any further excessive push-down of the tab T and prevent excessive deformation of the resilient contact piece 22. Further, even if only one side of the tab T is pushed down and the tab T is inclined in the entrance allowing space S1, the facing edge 24A on the same side contacts the tab T at a lateral side of the contact point 22A to restrict further excessive inclination of the tab T. In any of these cases, the resilient contact piece 22 is constantly in resilient contact with the tab T, thereby maintaining a state where the tab T and the resilient contact piece 22 are connected electrically.

On the other hand, since a width of the entrance allowing space S1, i.e. an inner dimension of the rectangular tube 10, is set larger than a width of the tab T, there is a possibility that the tab T is displaced toward one side in the entrance allowing space S1. Further, since the clearances are provided between the front straight portions 26 of the spring 20 and the side walls 13 of the rectangular tube 10, there is a possibility that the spring 20 is displaced toward one side in the rectangular tube 10. If a displacing direction of the tab T and that of the spring 20 are opposite directions, a positional deviation of the tab T and the spring 20 in the lateral direction is largest (hereinafter, referred to as a state with a maximum position deviation).

In this state, one side end part of the tab T is located above the facing edge part 24A of the inclination restricting portion 24, the upper edge 25A of the rear straight portion 25 and the upper edge 26A of the rear straight portion 26, whereas the other side end part is located at least above the rear end of the facing edge part 24A and the upper end edge 25A of the rear straight portion 25. Thus, even if only one side of the tab T is pushed down in this state and the tab T is inclined in the entrance allowing space S1, the rear end of the facing edge 24A and the upper end edge 25A of the rear straight portion 25 on the same side come into contact with the tab T as shown in FIG. 8(B) to restrict any further excessive inclination of the tab T. In any of these cases, since the resilient contact piece 22 is constantly resiliently in contact with the tab T, the state where the tab T and the resilient contact piece 22 are connected electrically is maintained.

Further, a front end part of the tab T in the rectangular tube 10 is located above the upper end edges 27A of the front restricting portions 27. Thus, if a front side of the tab T is pushed down and the tab T is inclined in the rectangular tube 10, the upper end edges 27A of the front restricting portions 27 come into contact with the tab T to restrict any further excessive inclination of the tab T. Further, if a rear end side of the tab T is pushed down, the inclination restricting portions 24 come into contact with the tab T. In this way, excessive inclination of the tab T in the front-rear direction and, further, excessive inclination thereof in the lateral direction and the front-rear direction (i.e. twisting in the entrance allowing space S1) are restricted.

As described above, the facing edges 24A of the inclination restricting portions 24 are continuously disposed from the upper edges 25A of the rear straight portions 25 to the upper edges 26A of the front straight portions 26. Thus, even if a positional relationship of the tab T and the spring 20 is any state between the state at the proper position and the state with the maximum positional deviation described above, the side ends of the tab T are located at least above the facing edges 24A at any positions in the lateral direction to restrict excessive inclination at the side end parts.

According to the configuration, since the inclination restricting portion 24 provided laterally to the contact point 22A comes into contact with the tab T when the tab T is inclined laterally in the rectangular tube 10, excessive inclination of the tab T is restricted. Further, since the inclination restricting portions 24 are disposed to be perpendicular to the ceiling wall 14 and the facing edges 24A facing the ceiling wall 14 come into contact with the tab T, excessive inclination of the tab T can be restricted with higher rigidity, for example, as compared to the case where the inclination restricting portions 24 are inclined walls disposed in a cantilevered state with plate surfaces held in parallel to the ceiling wall 14.

Further, since any one part of the inclination restricting portion 24 in the lateral direction can come into contact with the tab T, excessive inclination of the tab T can be restricted even if the tab T is displaced laterally.

Further, since the inclination restricting portion 24 is provided to couple the straight portions 25, 26, the inclination restricting portion 24 is less likely to fall down even upon receiving a strong force. Further, for example, in the case of forming the inclination restricting portion 24 and the straight portion 25 by bending one metal plate, the inclination restricting portion 24 can be arranged by adjusting a bending angle even if a clearance lateral to the contact point 22A is narrow. Further, since excessive inclination of the tab portion T is restricted at the lateral side of the contact point 22A, the contact point 22A and the tab T can be held connected.

Further, since excessive inclination of the tab T is restricted at four positions, i.e. at the two inclination restricting portions 24 and the front restricting portions 27 aligned with the inclination restricting portions 24 in the front-rear direction, the connected state of the tab T and the contact point portion 22A is maintained stably.

Second Embodiment

Figure 9:
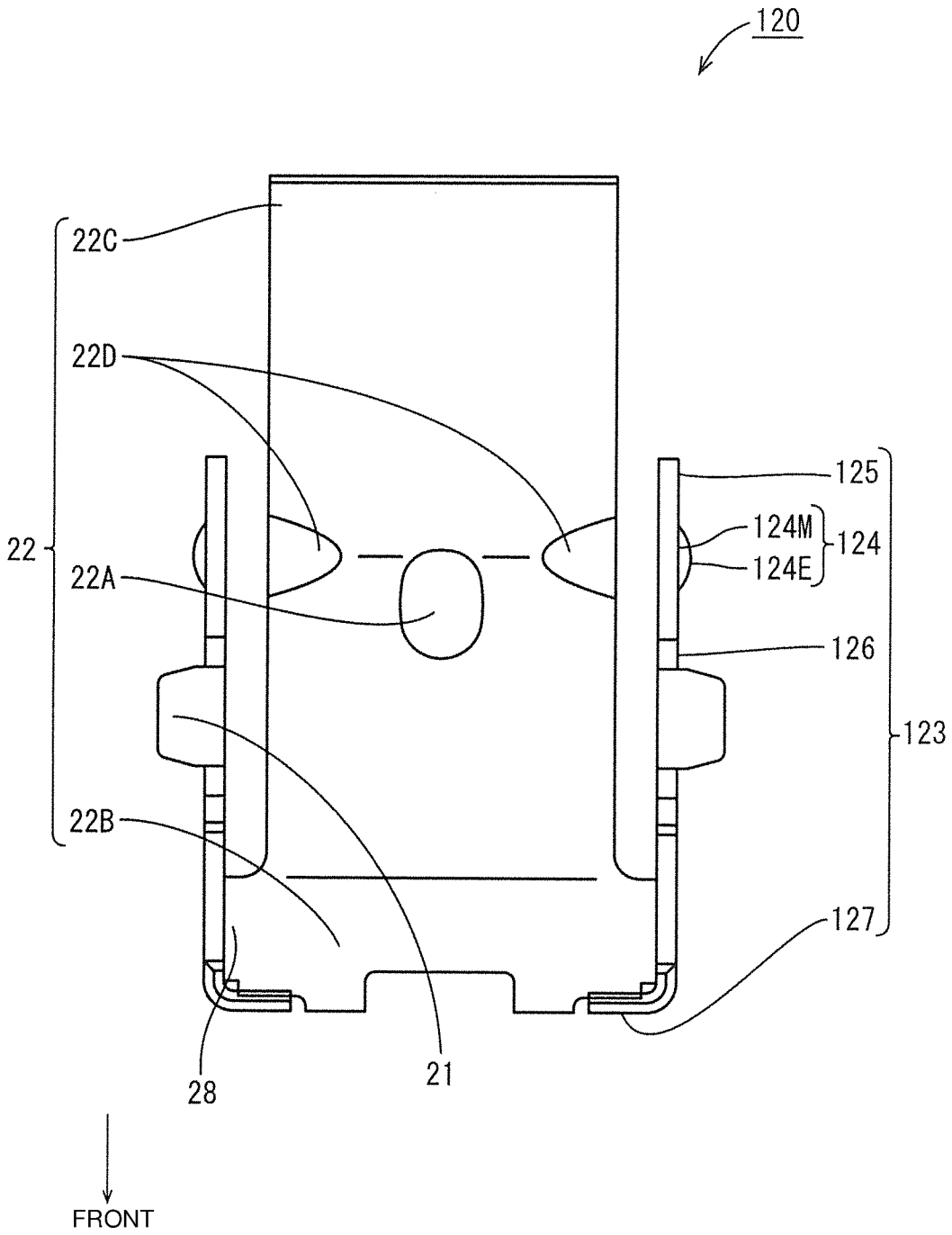
FIG. 9 is a plan view showing a spring member of a second embodiment.
Figure 10:
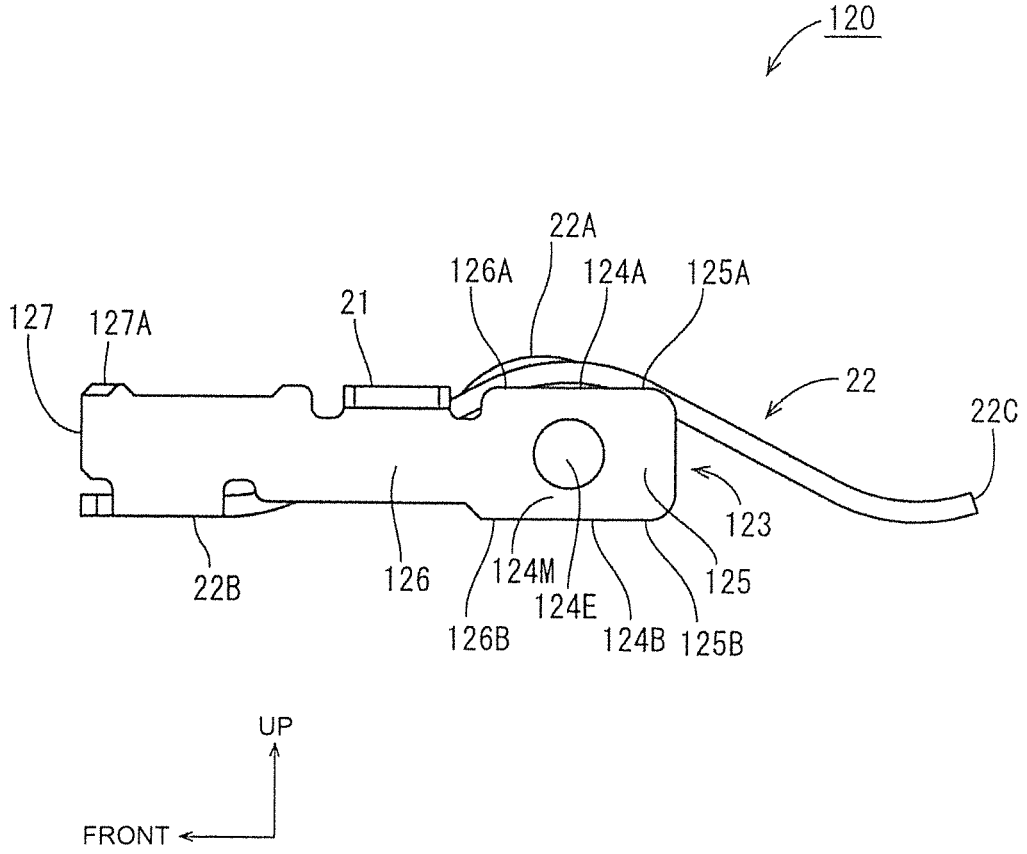
FIG. 10 is a side view showing the spring member.

A second embodiment is described with reference to FIGS. 9 to 11.

This embodiment differs from the first embodiment in the configuration of the spring 20 and components corresponding to those of the first embodiment are denoted by the same reference signs of the first embodiment plus 100. The same configurations, functions and effects as in the first embodiment are not described and the same components as the first embodiment are denoted by the same reference signs.

The inclination restricting portion 24 of the spring 20 extends straight in the direction intersecting the side edge of the resilient contact piece 22 in the first embodiment, whereas an inclination restricting portion 124 of a spring 120 includes a lateral straight portion 124M extending straight in parallel to a side edge of a resilient contact piece 22 and an embossed portion 124E provided on the lateral straight portion 124M and projecting laterally out in this embodiment. Note that the embossed portion 124E is formed by embossing.

A rear straight portion 125 is coupled to a rear end of the lateral straight portion 124M, and a front straight portion 126 is coupled to a front end of the lateral straight portion 124M. Specifically, in an inner wall 123 of this embodiment, the lateral straight portion 124M, the rear straight portion 125 and the front straight portion 126 are aligned along a straight line in a front-rear direction.

Figure 11A:
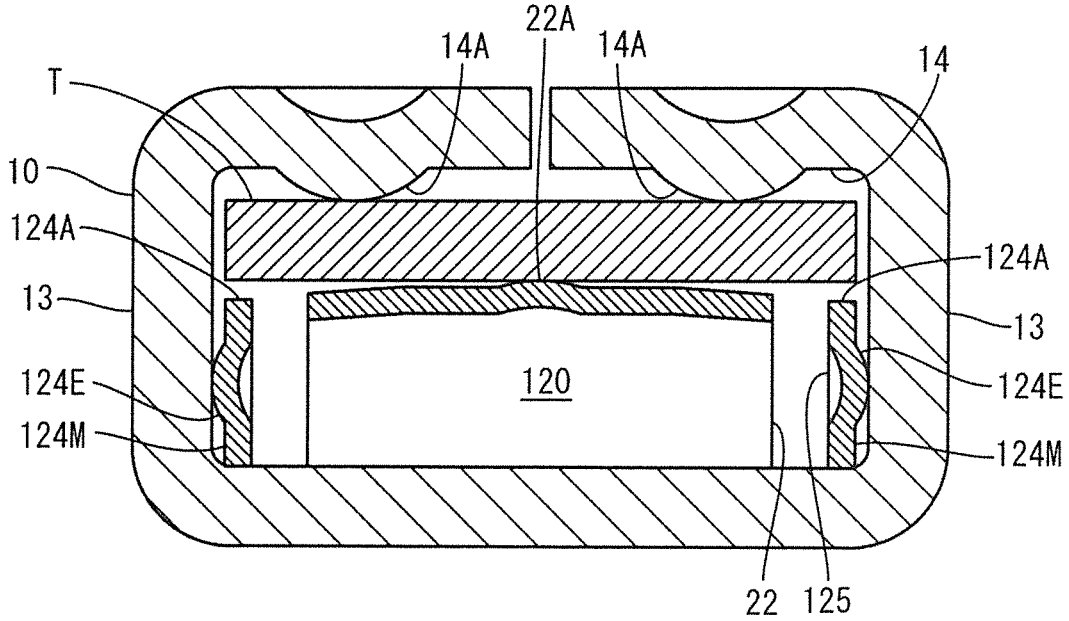
FIGS. 11(A) and 11(B) are sections showing a state at a proper position and a state with a maximum positional deviation.

With the spring 120 arranged in a rectangular tube 10, the lateral straight portions 124M are disposed near side walls 13 in clearances between the resilient contact piece 22 and the side wall portions 13 and a projecting end part of each embossed portion 124E is in contact with each side wall 13, as shown in FIG. 11(A). In this way, a displacement of the spring 120 in a lateral direction is suppressed in the rectangular tube portion 10.

If the spring 120 is disposed at a position where a center line thereof in the lateral direction is aligned with that of the rectangular tube 10, as shown in FIG. 11(A) (hereinafter, referred to as a state at a proper position), a tab T comes into contact with a contact point 22A of the resilient contact piece 22, is pressed against each contact ridge 14A by a resilient restoring force of the resilient contact piece 22 and is held in parallel to a ceiling wall 14. In this state, both side end parts of the tab T are located above facing edge parts 124A of the lateral straight portions 124M.

In this state, if the tab T is pushed down in a laterally balanced manner, the facing edges 124A contact the tab T to restrict any further excessive push-down of the tab T and prevent excessive deformation of the resilient contact piece 22. Further, even if only one side of the tab portion T is pushed down and the tab T is inclined in an entrance allowing space S1, the facing edge part 124A on the same side comes into contact with the tab T to restrict any further excessive inclination of the tab T.

Figure 11B:
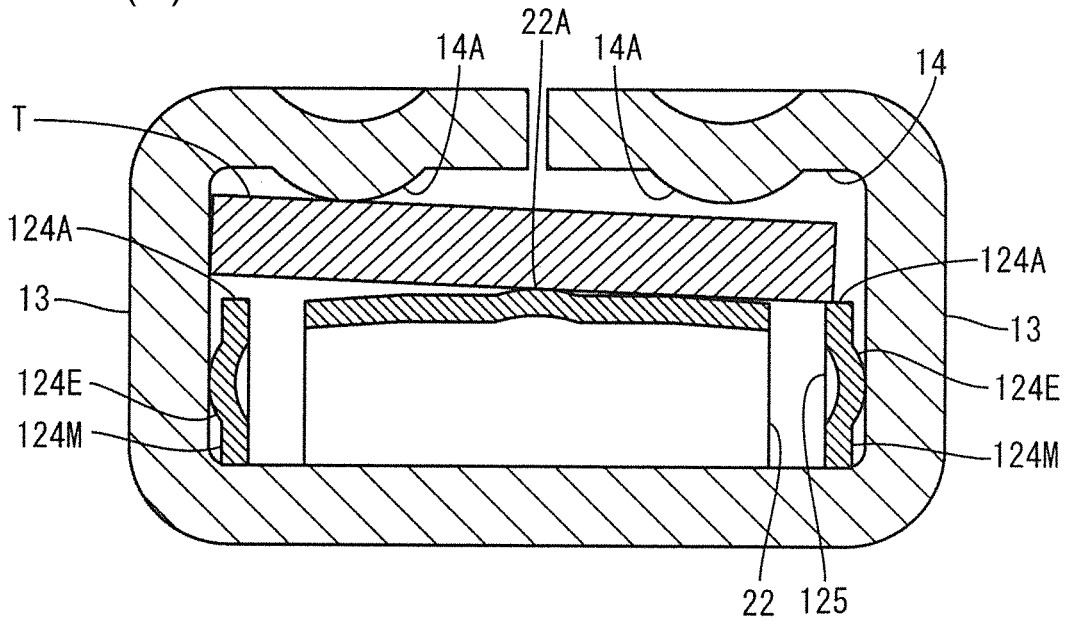

On the other hand, since a width of the entrance allowing space S1, i.e. an inner dimension of the rectangular tube 10, is larger than a width of the tab T, the tab T may be displaced toward one side in the entrance allowing space S1 (hereinafter, referred to as a state with a positional deviation of the tab portion). Also, in this state, both side end parts of the tab portion T are located above the both facing edges 124A. Thus, if only one side of the tab T is inclined down in this state with the positional deviation of the tab, the facing edge part 124A on the same side comes into contact with the tab T to restrict any further excessive inclination of the tab T, as shown in FIG. 11(B).

According to the configuration of this embodiment, since the embossed portions 124E are sandwiched between the lateral straight portions 124M and the side walls 13 at both sides of the resilient contact piece 22, a lateral displacement of the spring 120 in the rectangular tube 10 can be suppressed. In this way, the rattling of the inclination restricting portions 124 can be suppressed and a relative positional deviation from the tab T can be reduced.

Further, since a projecting height and a projecting shape of the embossed portion 124E can be freely adjusted by embossing, for example, if the embossed portion 124E is formed by embossing, the inclination restricting portion 124 can be provided even if the clearance between the resilient contact piece 22 and the side wall 13 is small.

Third Embodiment

Figure 12:
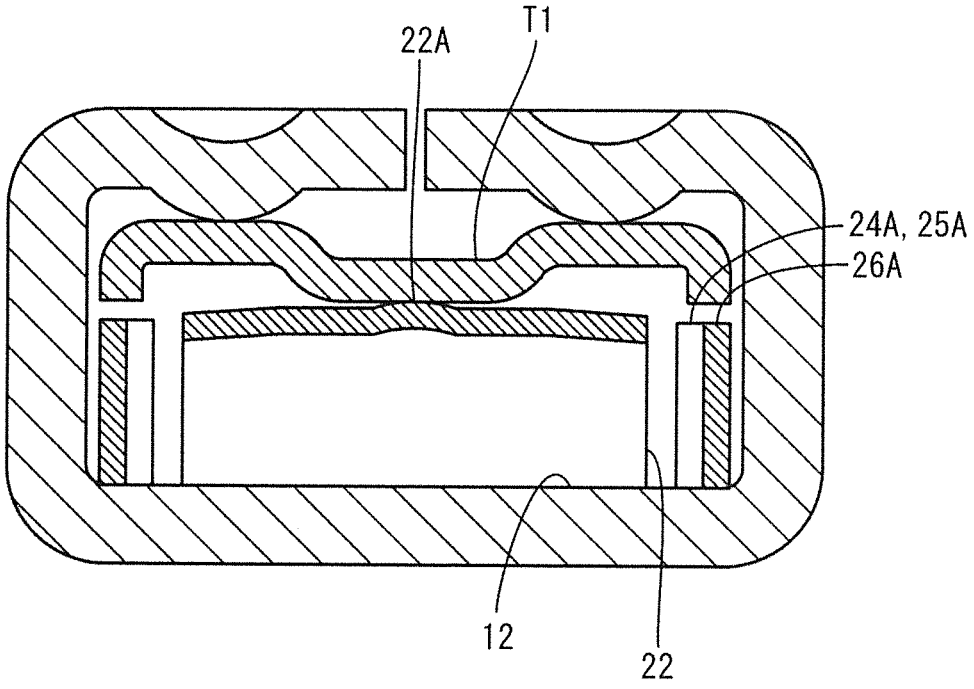
FIG. 12 is a section showing a terminal and a mating terminal of a third embodiment.

Next, a third embodiment is described with reference to FIG. 12.

This embodiment includes a tab T1 obtained by changing configuration of the tab T of the first embodiment, the same components, functions and effects as in the first embodiment are not described and the same components as in the first embodiment are denoted by the same reference signs.

The tab T of the first embodiment has a flat rectangular cross-sectional shape, whereas a tab T1 of this embodiment has an M-shaped cross-sectional shape so that both side ends are bent down and a central part projects down. In this way, high rigidity is obtained while the tab T1 is made thinner than the tab T.

Also, in the case of employing the tab T1 having such a shape, since facing edge parts 24A of inclination restricting portions 24 are disposed at both lateral sides of a contact point 22A, excessive inclination is restricted at lateral sides of the contact point 22A as in the first embodiment even if one side of the tab T1 is pushed down and inclined.

OTHER EMBODIMENTS

The invention is not limited to the above described and illustrated embodiments and can be embodied in the following forms.

Although the inclination restricting portions 24 are at both sides of the contact point 22A of the inclination restricting portions 24 in the first to third embodiments, an inclination restricting portion may be provided only at one side of a contact point.

Although the inclination restricting portion 24 extends in the direction intersecting the front-rear direction in the rectangular tube 10 in the first embodiment, the inclination restricting portion 24 need not extend in the direction intersecting the front-rear direction and may, for example, be parallel to the front-rear direction.

Although the rear straight portion 25 is coupled to the rear end of the inclination restricting portion 24 and the front straight portion 26 is coupled to the front end of the inclination restricting portion 24 in the first embodiment, either one or neither of the rear and front straight portions may be provided. For example, an inclination restricting portion may extend straight in a direction intersecting the front-rear direction from a bending edge part to a position lateral to a contact point portion.

Although the inner wall 23 includes the front restricting portion 27 disposed in front of the corresponding inclination restricting portion 24 in the first to third embodiments, no front restricting portion may be provided. Further, for example, instead of providing the front restricting portions, inclination restricting portions may be provided at two positions at one side or each of the sides of a contact point.

Although the lateral straight portions 124M, the rear straight portions 25 and the front straight portions 26 are disposed near the side walls 13 in the rectangular tube 10 in the second embodiment, the projecting heights of the embossed portions 124E can be set in accordance with the clearances between the lateral straight portion 124M and the side walls 13 if the embossed portions 124E are formed by embossing. Thus, lateral straight portions, rear straight portions and front straight portions may be disposed near a resilient contact piece and projecting end parts of embossed portions may be brought into contact with respective side walls by increasing projecting heights of the embossed portions toward the respective side walls.

LIST OF REFERENCE SIGNS

T: tab
1: terminal
10: rectangular tube
11: cut
12: bottom wall
13: side wall
14: ceiling wall
22: resilient contact piece
22A: contact point portion
23: inner wall
24: inclination restricting portion
24A: facing edge part
25: rear straight portion
26: front straight portion
27: front restricting portion

What is claimed is:

1. A terminal comprising:

a rectangular tube open in a front-rear direction and having a bottom wall, two side walls rising from the bottom wall and a ceiling wall continuous from the side walls and disposed to face the bottom wall; and a spring arranged in the rectangular tube and including a resilient contact piece provided with a contact point facing the ceiling wall and first and second inner walls arranged respectively between the resilient contact piece and each of the side walls, portions of the inner walls aligned with the contact point in the front-rear direction defining inclination restricting portions, each of the inclination restricting portions provided with a facing edge part facing the ceiling wall and arranged perpendicular to the ceiling wall at a lateral side of the contact point.

2. The terminal of claim 1, wherein the inclination restricting portion extends in a direction intersecting the front-rear direction.

3. The terminal of claim 2, further comprising a straight portion extending along the side wall from one end of the inclination restricting portion, wherein the inclination restricting portion and the contact point overlap in a side view.

4. The terminal of claim 2, wherein the inclination restricting portion includes a straight portion extending straight along the side wall and an embossed portion projecting toward the side wall.

5. The terminal of claim 1, further comprising a front restricting portion arranged perpendicular to the ceiling wall and disposed side by side with the inclination restricting portion in the front-rear direction.

6. The terminal of claim 1, wherein the resilient contact piece extends in the front and rear ends, first and second bending edges protrude respectively from opposite sides of the front end of the resilient contact piece in directions transverse to the front-rear direction, and the first and second inner walls extend rearward respectively from the first and second bending edges.

7. The terminal of claim 1, wherein the first and second inner walls are spaced from the resilient contact piece in directions transverse to the front-rear direction.

* * * * *